United States Patent [19]

Kindle et al.

[11] 4,405,072

[45] Sep. 20, 1983

[54] SETTING DEVICE POWERED BY AN EXPLOSIVE GAS MIXTURE

[75] Inventors: Edwin Kindle, Triesen, Liechtenstein; Peter Jochum, Meiningen, Austria

[73] Assignee: Hilti Aktiengesellschaft, Schaan, Liechtenstein

[21] Appl. No.: 267,593

[22] Filed: May 27, 1981

[30] Foreign Application Priority Data

May 28, 1980 [DE] Fed. Rep. of Germany ..... 3020268

[51] Int. Cl.[3] ..... B25C 1/08

[52] U.S. Cl. ..... 227/10

[58] Field of Search ..... 60/632, 633, 635; 227/8, 9, 10

[56] References Cited

U.S. PATENT DOCUMENTS 3,850,359 11/1974 Obergfell ..... 227/10
4,200,213 4/1980 Liesse ..... 227/10
4,260,092 4/1981 Austin ..... 227/8

FOREIGN PATENT DOCUMENTS 2700949 7/1978 Fed. Rep. of Germany ..... 227/8

*Primary Examiner*—Mark Rosenbaum
*Attorney, Agent, or Firm*—Toren, McGeady and Stanger

[57] ABSTRACT

A fastening element setting device powered by an explosive gas mixture includes a housing forming a guide cylinder for a propulsion piston which drives the fastening element into a receiving material. The components of the gas mixture, one at a higher pressure than the other, are delivered through separate supply lines into an inlet duct and then to a combustion chamber. A control slide valve is located between the supply lines and the inlet duct and regulates flow, with the higher pressure component following the lower pressure component into the inlet duct and combustion chamber. A closure valve in the supply line of the lower pressure component blocks any inflow when the higher pressure component flows into the inlet duct.

9 Claims, 5 Drawing Figures

SETTING DEVICE POWERED BY AN EXPLOSIVE GAS MIXTURE

SUMMARY OF THE INVENTION

The present invention is directed to a fastening element setting device powered an explosive gas mixture and includes a guide cylinder with a propulsion piston mounted in the cylinder and driven by the pressure generated in a combustion chamber by the ignition of the explosive gas mixture. The combustion chamber is located at one end of the guide cylinder and faces in the driving direction of the propulsion piston. An ignition device extends into the combustion chamber for igniting the gas mixture. The flow of two components of the gas mixture into the combustion chamber is regulated by a control slide valve so that the components flow, one after the other, into the combustion chamber. A pair of supply lines carry the gas mixture components to the control slide valve and each component is at a different pressure. A recoil valve is located in the path of flow of the components from the control slide valve to the combustion chamber.

In a known setting device for driving nails into a receiving material and powered by an explosive gas mixture, the propulsion piston driving the fastening elements is propelled by a gas mixture of propane and air. The gas mixture is held at the charge pressure in a combustion chamber in readiness to be ignited by a spark plug or heater plug. The pressure generated by ignition of the gas mixture opens a main valve admitting the combustion pressure to the rear end of the propulsion piston and the piston is accelerated through the guide cylinder and drives a nail into the receiving material.

The components forming the gas mixture are admitted one after the other, each at a different pressure, into the combustion chamber and such flow is regulated by a control slide-valve. To prevent any backflow of the gas mixture from the combustion chamber into the inflow duct toward the control slide-valve, a non-return valve is provided in the duct. The propane component, at a lower pressure than the air, is charged into a storage chamber before being admitted into the combustion chamber. The storage chamber is supposed to insure, among other things, that the part of the gas mixture which remains in the inflow duct after the non-return valve has been closed, with the pressure of the mixture corresponding to that of air, does not flow back into the propane supply line during any subsequent displacement of the control slide-valve. If there was any backflow it would lead to an adulteration of the propane to be subsequently mixed with air, and it would also cause a change in the propane pressure in the supply line with resultant control difficulties.

A considerable shortcoming of the known device is its limited power output. The limitation occurs because of the extent to which the combustion chamber can be filled, because it receives only a small quantity of propane and the propane is held in the storage space under supply pressure so that the quantity of propane is only that amount which flows into the combustion chamber for effecting pressure equalization.

Another shortcoming of this known device is its elaborate construction requiring a plurality of control lines as well as a storage chamber. Experience has shown that such an arrangement leads to an increased possibility of breakdown. In addition, the device involves a complicated mode of operation with the control slide-valve being operated manually and separately from the manual operation of the ignition process.

Therefore, it is the primary object of the present invention to provide a fastening element setting device powered by an explosive gas mixture in which a high power output can be achieved along with constructional, functional and operational simplicity.

In accordance with the present invention, the supply line for the lower pressure component of the gas mixture is provided with a closure valve which blocks any flow while the higher pressure component is admitted through the control slide-valve.

In accordance with the present invention, the setting device has a high output capacity. The reason for this is that both mixture components flow into the combustion chamber under the source pressure prevailing in the supply lines without the interposition of a storage chamber which reduces the pressure of one of the components. For effective performance, suitable gas components of the mixture are, in particular, propane and oxygen with the oxygen at a higher pressure than the propane. As in the known devices, propane is first charged into the combustion chamber and, subsequently, the other component, such as oxygen, at a higher pressure is admitted for forming the mixture.

Other important advantages involve a simpler assembly, a smaller number and shorter control lines and a simpler operating sequence.

A structurally simple and functionally effective closure valve construction is provided if the valve body is biased by spring means against the flow direction of the mixture components with low pressure. Preferably, a compression spring is used, since such a spring is characterized by a low degree of fatigue.

To increase the pressure effecting the closing of the closure valve, and thus the degree to which it closes securely, it is advantageous to interconnect the closure valve and the supply of the higher pressure component being supplied to the combustion chamber. By admitting the higher pressure component to the same side of the closure valve as the compression spring, a combined closing action is effected on the valve body.

Moreover, the handling of the setting device is considerably facilitated by means of an actuation member for moving the control slide-valve. The actuation device is preferably a part of a member projecting from the muzzle end of the setting device when the device is not in use. When a fastening element is to be driven into a receiving material, the muzzle end of the setting device is pressed against the receiving material and the member moves inwardly into the setting device. The member is coupled to the control slide-valve in a simple manner so that, as the setting device is pressed against the receiving material, the control slide-valve is automatically displaced into the operating position. To simplify the operation of the setting device, the control slide-valve is arranged to cooperate with the ignition means to provide ignition only after a certain displacement movement of the valve takes place. With such an arrangement it is assured that the ignition device is triggered only after the control slide valve is moved into a position assuring that the required gas mixture is present in the combustion chamber.

For a further simplification of the setting device, a retaining assembly is provided within the device to hold the propulsion piston in place until the gas mixture is ignited. As a result, it is unnecessary to provide any elaborate structure to prevent movement of the piston by the charge pressure of the gas mixture in the combustion chamber. In the known setting device discussed above, the main valve experiences certain technical problems with regard to control and wear and tear.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
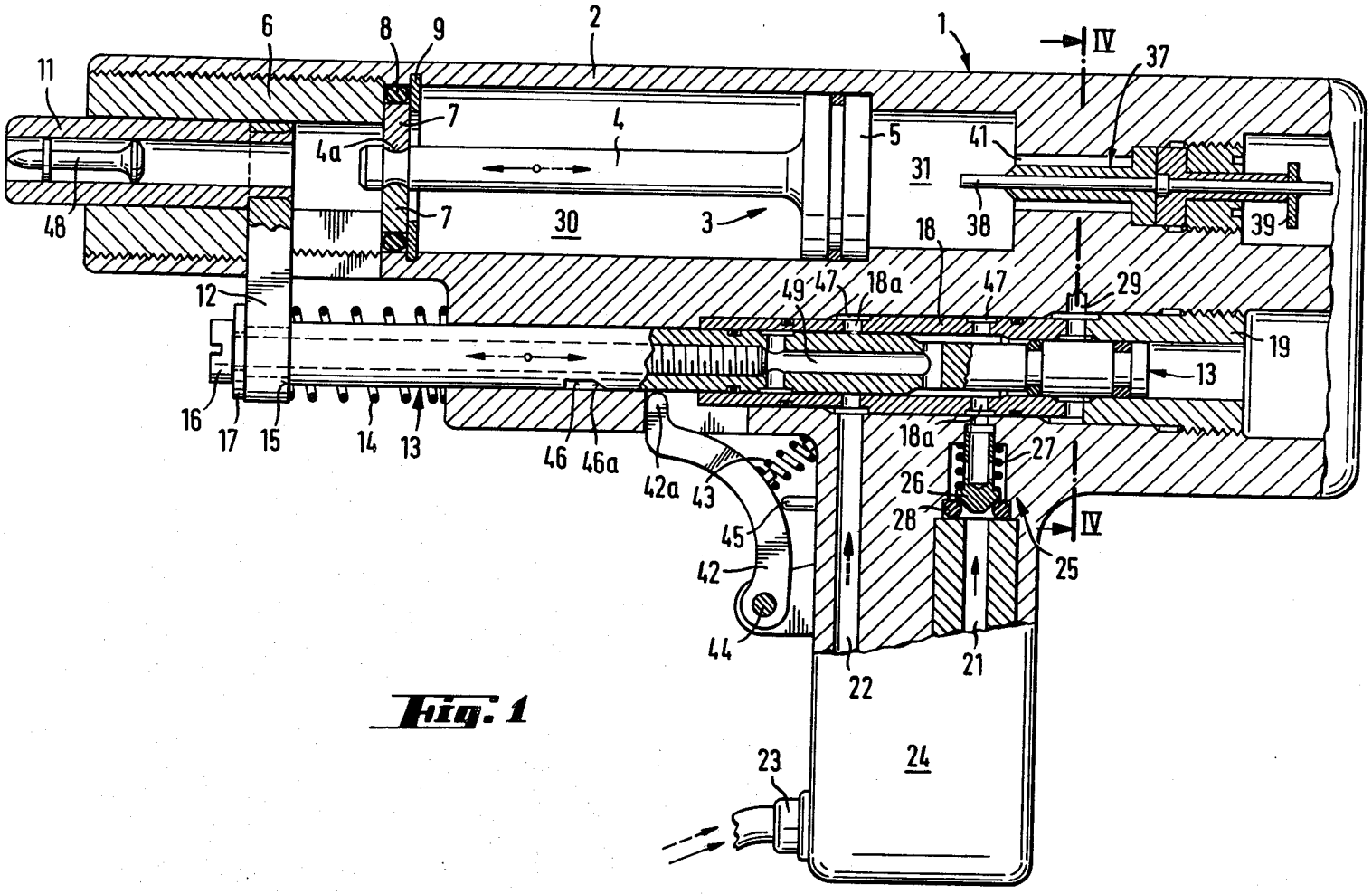
FIG. 1 is a side view, mostly in section, of a setting device embodying the present invention with the section taken along the line I—I in FIG. 4 and with the device illustrated in the at rest position.

In FIG. 1 a fastening element setting device is illustrated and includes a housing 1 with the housing having a left or front end from which a fastening element can be driven and a rear or right end. The front end portion of the housing 1 forms a guide cylinder 2 in which a propulsion piston 3 is displaceably mounted. As shown in FIG. 1 the piston is positioned to be driven through the guide cylinder 2 toward the front end of the housing for driving the fastening element 48 into the receiving material. Piston 3 is made up of an axially elongated shank 4 and a head 5 at the rear end of the shank. The head 5 of the piston 3 has a much larger diameter than the shank and is disposed in sliding contact with the inside surface of the guide cylinder 2. A sleeve 6 is screwed into the front end of the guide cylinder 2 and bears at its inner end against a pair of radially movably mounted holding jaws 7. Jaws 7 engage in a groove **4*a* formed around the front end of the shank 4. A clamping ring 8 encircles the outer circumference of the holding jaws 7, and biases the jaws inwardly into engagement with the groove 4*a*. Abutting against the rear face of the jaws 7 and the clamping ring 8 is an annular disc 9** which serves as a support preventing the jaws and ring from being displaced inwardly.

Sleeve 6 slidably supports a tubular fastening element guide 11. When the piston is driven forwardly its front end enters into the guide 11 into contact with the fastening element which it then drives into the receiving material. At the rear end of the guide 11 a transverse arm 12 is secured which extends outwardly through a slot formed in the sleeve 6 and the guide cylinder 2. Exteriorly of the housing, the arm 12 is secured to the front end of a control slide valve 13. The unit formed of the fastening element guide 11, the transverse arm 12 and the control slide valve 13 is biased into the position shown in FIG. 1 by a spring 14. At its rear end the spring 14 bears against the housing and at its front end it contacts a supporting shoulder 15 formed by the transverse arm 12. At its front end, the control slide-valve 13 is secured by means of a screw 16 and disc 17 and also by the shoulder 15 on the arm 12. The control slide-valve 13 is slidably mounted within the housing 1 extending rearwardly from the arm 12 toward the rear end of the housing and, within the housing, it is movably mounted in an axially extending control bush 18 and a guide bush 19.

Housing 1 includes a handle 24 intermediate its front and rear ends with a supply line 21 for propane and a supply line 22 for oxygen extending through the handle to the control slide-valve 13. The supply lines 21, 22 are connected to external sources by a connecting member 23 at the lower end of the handle. In propane supply line 21, a closure valve 25 is located adjacent the control slide-valve 13. Closure valve 25 includes a valve body 26 held in the closed position against an elastic gasket 28 forming the valve seat by a compression spring 27.

Figure 4:
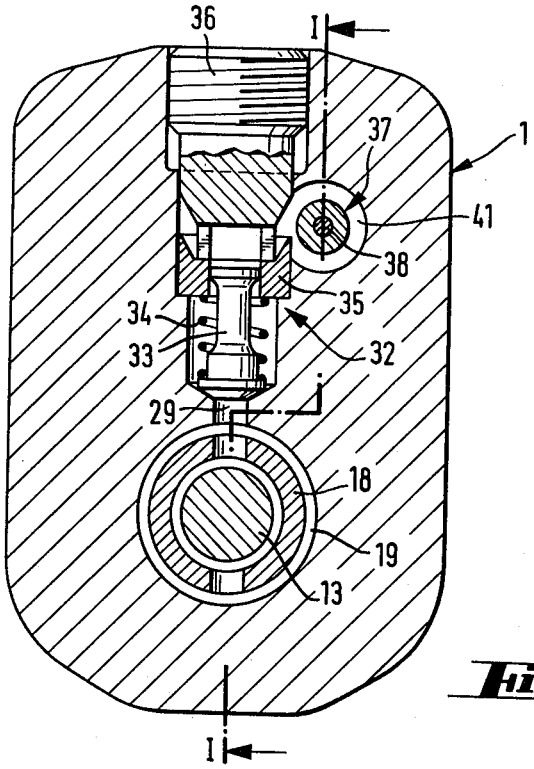
FIG. 4 is a transverse sectional view taken along the line IV—IV in FIG. 1 and illustrating a back pressure valve in the closed position.
Figure 5:
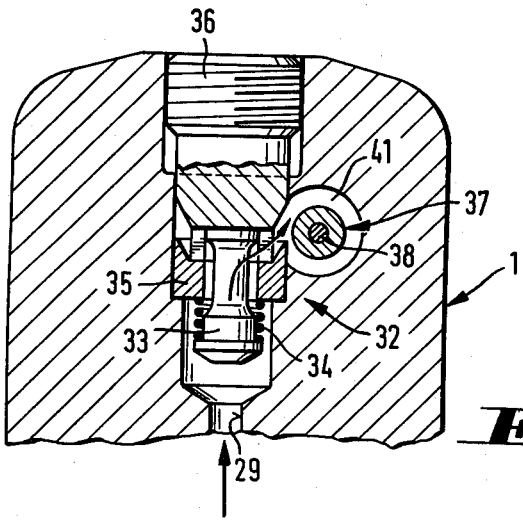
FIG. 5 is a sectional view taken along the line V—V in FIG. 2 and displaying the back pressure valve in the open position.

Oxygen supplied through the line 22 is at a higher pressure than the propane. As the control slide-valve 13 is displaced toward the rear end of the housing, initially the propane is admitted to an inflow duct 29 and then into a combustion chamber 31 at the rear end of the cylinder space 30 formed within the guide cylinder 2. As is shown in FIG. 4, a back pressure valve 32 is located in the inflow duct 29 and includes a valve body 33 held in the closed position by a spring 34. A ring body 35 is located in the inflow duct 29 and supports the upper end of the spring 34 and also guides the valve body 33 when it is moved into the open position permitting the passage of the gas mixture components into the combustion chamber 31 by way of a ring slot 41, note FIG. 5. The upper end of the inflow duct is closed by a stopper 36.

Ignition of the gas mixture within the combustion chamber 31 is effected by a spark plug 37, note FIG. 1. The spark plug 37 includes a center electrode 38 projecting into the combustion chamber and the electrode is supplied with an ignition impluse via a connection lug 38 from a power source, not shown. The front end of the spark plug adjacent the combustion chamber 31 is encircled by a ring slot 41 opening into the combustion chamber. The rear end of the plug is screwed in a sealed manner into the housing 1.

Asymmetrically disposed relative to the ring slot 41 is the inflow duct 29, note FIG. 4. Inflow duct 29 extends approximately tangentially of the ring slot 41 so that the gas mixture components flow from the duct into the ring slot during each filling operation and provide an effective cleansing of the spark plug as the components flow over it and also afford an effective mixing of the components.

To initiate ignition, a trigger 42, spring biased into its at rest position by a spring 43, is pivoted on a pin 44. When the triggger 42 is pressed against the force of spring 43, it pivots about the pin 44 and activates an electric switch 45 only partially illustrated. Trigger 42 can only be displaced for effecting ignition if the gas mixture has been established in the combustion chamber 31. Before the trigger can be pivotally displaced, the control slide-valve 13 must be displaced rearwardly against the spring 14 and this is accomplished by pressing the front end or muzzle end of the setting device against a receiving material causing the fastening element guide 11 to slide inwardly within the sleeve 6. When the valve 13 is moved into the end position of FIG. 3 it has a recess 46, note FIG. 1, aligned opposite the projection 42*a* on the trigger 42 so that the trigger can pivot upwardly into the recess 46 and activate the switch 45. After ignition takes place, the control slide-valve 13 is pressed forwardly by the spring 14 and moves into the at rest position shown in FIG. 1 when the setting device is removed from the receiving material. As the slide-valve 13 moves forwardly, the slanted surface 46*a* within the recess 46 contacts the projection 42*a* on the trigger 42 and moves the trigger back into its initial position.

Connection member 23 joins the setting device to external sources of the gas mixture components propane and oxygen. Propane is present in the supply line 21 and it presses against the closure valve 25. If the pressure in the relatively small volume control space situated upstream in the supply line of the closure valve 25, is lower than the propane pressure, the valve body is lifted against the spring action until a pressure equalization takes place. With pressure equalization, the valve body 26 is biased back into the closed position by the spring 27. At the same time, oxygen supply line 22 is closed by the control slide-valve located in the at rest position. The gas mixture components flow from the supply lines 21, 22 into ring ducts 47 and then into bores 18*a* through the control bush 18.

After a fastening element 48 is inserted into the guide 11, the muzzle end of the setting device is pressed against a receiving material, not shown, and the fastening element guide 11 slides into the sleeve 6 carrying with it the transverse arm 12 which, in turn, displaces the control slide-valve 13 toward the rear end of the housing against the biasing force of the spring 14. This rearward displacement of the guide 11 and the arm 12 acts as an activating means for the control slide valve 13 moving it rearwardly within the housing so that the components of the gas mixture can flow, in turn, into the combustion chamber 31.

The following is an explanation of the manner in which the control slide-valve 13 admits the gas components into the combustion chamber for mixing.

When the setting device is in the at rest position, displayed in FIG. 1, the two gas components are present in the supply line 21, 22 and are prevented from further flow by the control slide valve 13. When the control slide-valve 13 is moved rearwardly from the position shown in FIG. 1 to that displayed in FIG. 2, an intermediate position of the valve, a connection between the supply line 21 containing the propane component of the mixture and the inflow duct 29 is effected. Since the combustion chamber 31 is at atmospheric pressure, with the slide-valve 13 in the above-mentioned position, the pressure of the propane in the supply line 21 opens the closure valve 25 and the back pressure valve 32, note FIG. 5, and a flow of propane into the combustion chamber 31 takes place. The inflow of propane to the combustion chamber 31 occurs within a fraction of a second. The propane flows through the valve body 26, the ring duct 47 and the bores 18*a* into the space formed between the bush 18 and the slide-valve 13 and finally passes into the inflow duct 29 through the back pressure valve 32 and then into the combustion chamber.

Figure 2:
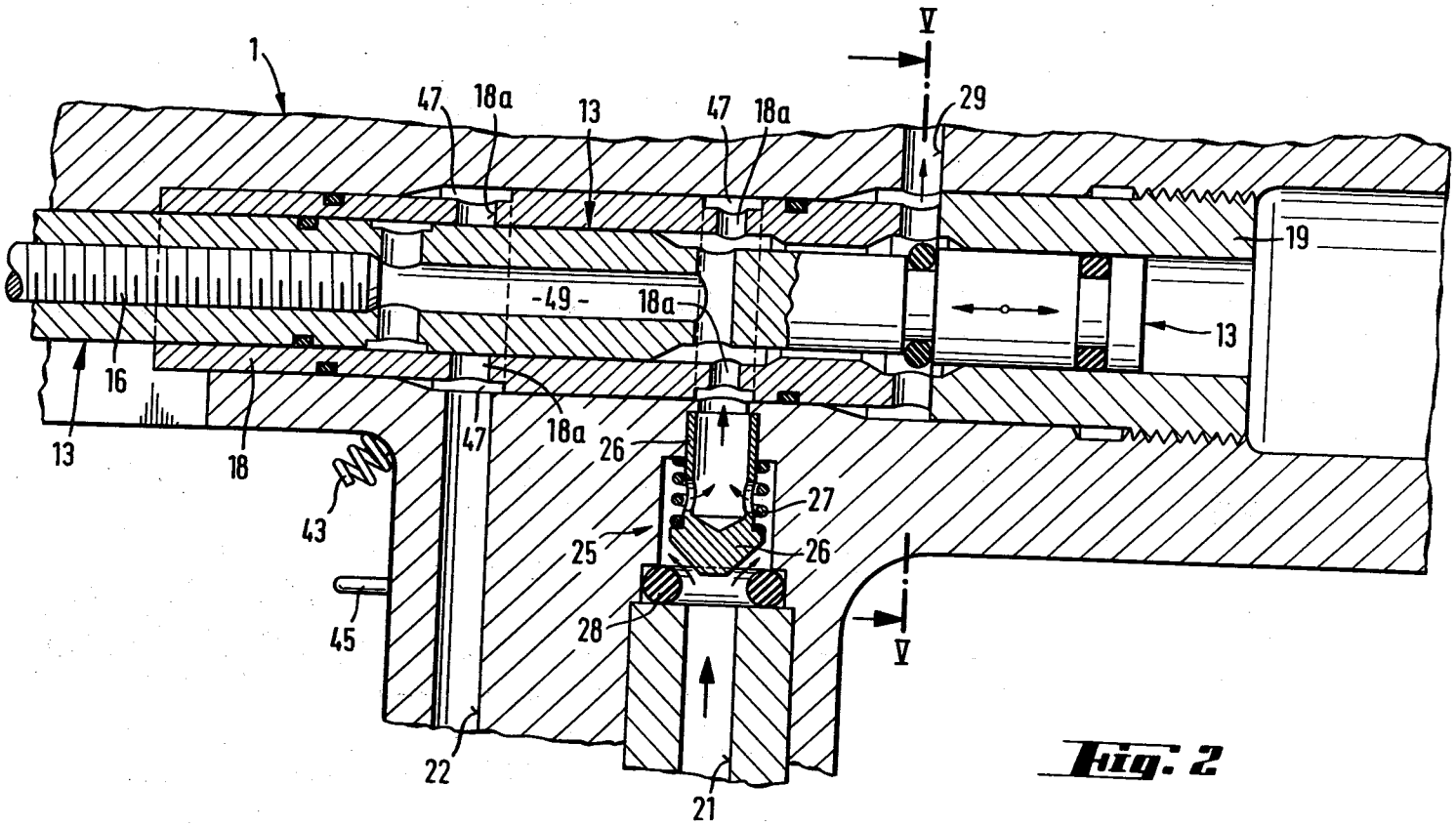
FIG. 2 is an enlarged sectional partial view of the setting device illustrated in FIG. 1 showing the control arrangement with the control slide-valve partly displaced from the at rest position shown in FIG. 1.

As can be seen in FIG. 2 gasket seals are provided, however, these seals do not have any fundamental functional significance and no further description is necessary.

When the propane in the combustion chamber 31 is at the same pressure as in the supply line 21, the springs acting on the back pressure valve 32 and the closure valve 25 cause both of these valves to close cutting off the flow of propane.

As the components of the gas mixture are introduced into the combustion chamber, the propulsion piston 3 remains in the position shown in FIG. 1 and is not displaced by the pressure of the gas mixture within the combustion chamber. The piston 3 is held in place by the holding jaws 7 which are pressed inwardly by the elastic clamping ring 8 so that the jaws are securely seated within the groove 4*a* in the front end of the shank 4 of the piston 3. As the setting device is pressed against the receiving material, the control slide valve 13 continues to move rearwardly until it reaches its end position exhibited in FIG. 3. In this end position, the slide-valve forms an opening from the oxygen supply line 22 into the connection duct 49 in the valve 13 so that the oxygen can flow into the inflow duct 29. Since the oxygen pressure is significantly higher than the propane pressure previously introduced into the combustion chamber 31 the oxygen opens the back pressure valve 32 and flows into the combustion chamber 31. As a result, the combustion chamber 31 is filled with a gas mixture having a pressure determined by the oxygen pressure. When the pressure within the combustion chamber reaches the oxygen pressure, the back pressure valve 32 closes and blocks any further flow into the combustion chamber.

Figure 3:
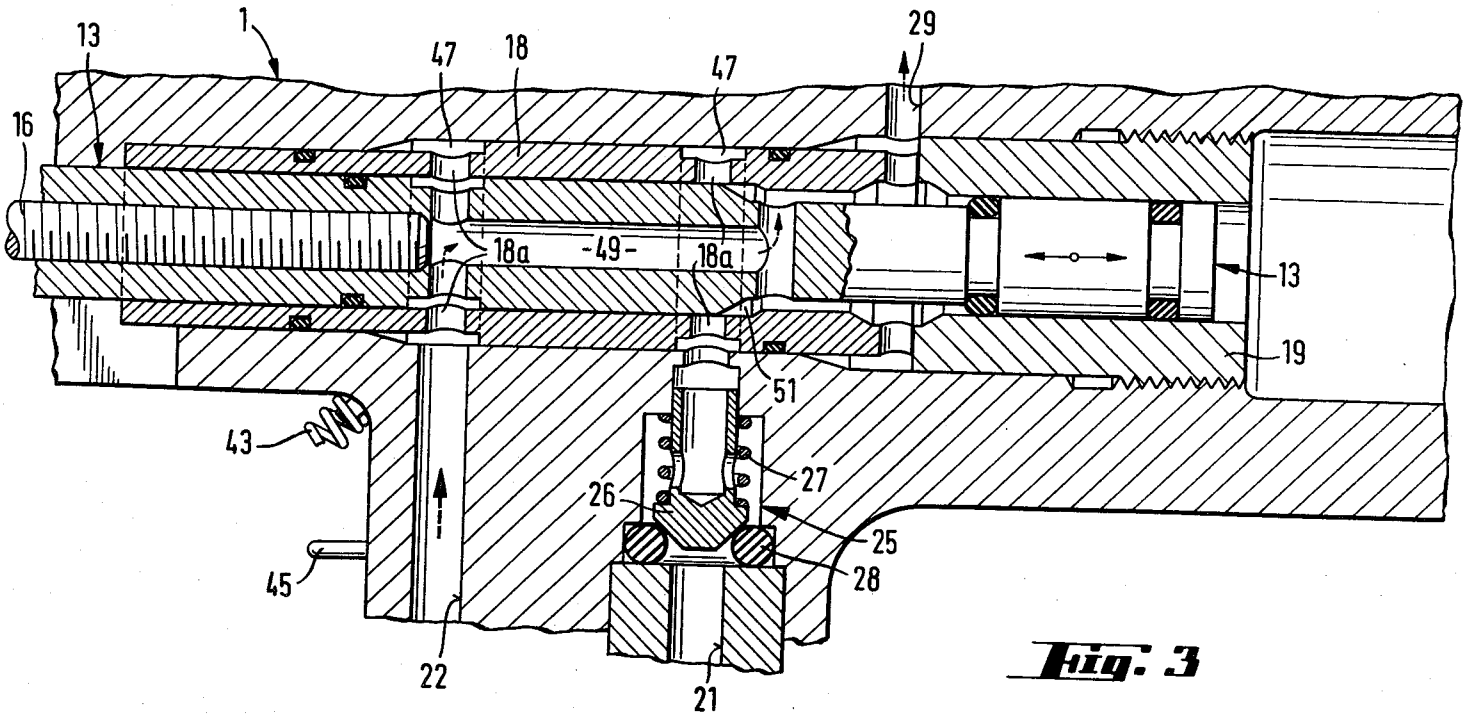
FIG. 3 is another view similar to FIG. 2 with the control slide-valve fully displaced from the at rest position.

With the control slide in the rearward position of FIG. 3, recess 46 is aligned above the projection 42*a*, not shown in FIG. 3, and the trigger can be pivoted about the pin 44 activating the switch 45 so that an ignition impulse is delivered to the spark plug 37 and the gas mixture is ignited. With the ignition or explosion of the gas mixture, high pressure gases are developed within the combustion chamber 31 which greatly exceed the original charge pressure of the components within the chamber and the pressure is such that it overcomes the holding action of the clamping ring 8 and the holding jaws 7 releasing the propulsion piston 3 for acceleration toward the forward end of the setting device. The piston drives the fastening element out of the guide 11 into the receiving material.

By removing the setting device from the surface of the receiving material, the control slide-valve 13 is returned into the forward at rest position, illustrated in FIG. 1 by the spring 14. At the same time, the closure valve 25 is maintained in the closed position by the spring 27 assuring that any oxygen under high pressure remaining in the inflow duct does not flow back into the supply line 21 containing the propane at a relatively lower pressure. To reinforce the closing action of the closure valve 25, a passageway 51, note FIG. 3, admits a flow of the oxygen back into the space containing the closure valve 25. The presence of the higher pressure oxygen adds an additional closing force against the valve body 26. Thereafter, it is only necessary to return the operating piston 3 back into its initial position, as shown in FIG. 1, and the setting device is ready for another fastening element setting cycle. The return of the piston 3 to its initial position can be effected by conventional means well known in the setting device art.

To prevent any outflow of the gas mixture components through the inflow duct 29 and the combustion chamber 31 and other openings not shown, into the atmosphere after the completion of the fastening element setting cycle, when the pressure in the combustion chamber and the cylinder space 30 has dropped, the control slide-valve is constructed so that it immediately returns into the at rest position shown in FIG. 1 blocking off any flow of the components.

It can be appreciated that other gases can be used in place of propane and oxygen.

While specific embodiments of the invention have been shown and described in detail to illustrate the application of the inventive principles, it will be understood that the invention may be embedded otherwise without departing from such principles.

We claim:

1. A fastening element setting device powered by an explosive gas mixture comprising a housing forming an axially elongated guide cylinder having a front end and a rear end, a propulsion piston slidably mounted in said guide cylinder, a combustion chamber located within said housing and opening into the rear end of said guide cylinder, an ignition device mounted within said housing and having a part thereof located within said combustion chamber for igniting an explosive gas mixture within said combustion chamber and generating pressurized gases for driving said propulsion piston in said guide cylinder, a first supply line in said housing for a first component of the gas mixture, a second supply line in said housing for a second component of the gas mixture with the second component being at a higher pressure than the first component, a control slide-valve displaceably mounted in said housing and located between said first and second supply lines and said combustion chamber for controlling the flow of the components of the explosive gas mixture one after the other into said combustion chamber, an inflow duct extending between said control slide-valve and said combustion chamber, a back-pressure valve located in said inflow duct between said control slide valve and said combustion chamber, and a closure valve in said first supply line disposed in the closed position when the higher pressure component of the gas mixture flows from said second supply line to said combustion chamber.

2. A fastening element setting device, as set forth in claim 1, wherein said closure valve comprises a valve body and spring means biasing said valve body into the closed position against the inflow direction of the gas mixture component within said first supply line.

3. A fastening element setting device, as set forth in claims 1 or 2, wherein said control slide valve being displaceable from a forward at rest position to an intermediate position for admitting flow from the first supply line into said combustion chamber and a rear end position for admitting flow from said second supply line into said combustion chamber, and in the rear end position, said control slide valve forming a passageway communicating with said closure valve in said first supply line for admitting the higher pressure gas component into contact with said closure valve for reinforcing the closing action of said valve.

4. A fastening element setting device, as set forth in claims 1 or 2, including means displaceably mounted on said housing and in engagement with said control slide valve for displacing said control slide valve into position for admitting flow from said first and second supply lines to said combustion chamber.

5. A fastening element setting device, as set forth in claim 4, wherein said housing having a front end from which fastening elements are driven, said means comprises a guide slidably displaceably mounted in the front end of said housing in the driving direction of said propulsion piston, an arm secured to and extending transversely outwardly from said guide with the end of said arm outwardly from said guide being fixed to said control slide-valve so that the sliding movement of said guide can be transferred via said arm to said control slide valve.

6. A fastening element setting device, as set forth in claims 1 or 2, comprising means mounted on said housing for actuating said ignition device.

7. A fastening element setting device, as set forth in claim 6, wherein said means for actuating said ignition device comprises a trigger pivotally mounted on said housing, said control slide valve having a recess therein arranged to register with a part of said trigger as said control slide-valve moves in said housing so that, with said trigger aligned with the recess in said control slide valve, said trigger can be pivoted for actuating said ignition device.

8. A fastening element setting device, as set forth in claims 1 or 2, wherein means are located with said guide cylinder for holding said propulsion piston to prevent said piston from being displaced by the pressure build-up when the gas mixture components are admitted into said combustion chamber.

9. A fastening element setting device, as set forth in claim 8, wherein said piston comprises a shank part and a head, said head having a larger diameter than said shank part and said head being disposed in slidable contact with said guide cylinder, a recess formed in said shank part, said means for locking said piston comprises locking jaws engageable within said recess in said shank part, an elastic clamping ring mounted within said guide cylinder and biasing said locking jaws into holding contact with said recess in said shank part of said piston.

* * * * *